United States Patent [19]

Coates

[11] 4,031,565

[45] June 28, 1977

[54] UNITARY BURIAL UNDERGARMENT

[76] Inventor: John H. Coates, Rte. 3, Box 572, Saluda, S.C. 29138

[22] Filed: Feb. 23, 1976

[21] Appl. No.: 660,275

[52] U.S. Cl. ..... 2/78 R; 2/409
[51] Int. Cl.[2] ..... A41B 9/00
[58] Field of Search ..... 2/78 R, 78 A, 79, 69, 2/78 C, 80, 409

[56] References Cited

UNITED STATES PATENTS

| | | | |
|---|---|---|---|
| 421,236 | 2/1890 | Burpee | 2/78 R |
| 429,665 | 6/1890 | Tozer | 2/78 R |
| 942,159 | 12/1909 | Appleton | 2/78 R |
| 1,190,448 | 7/1916 | Murray | 2/78 R |

FOREIGN PATENTS OR APPLICATIONS

| | | | |
|---|---|---|---|
| 505,478 | 9/1951 | Belgium | 2/79 |
| 2,093,212 | 1/1972 | France | 2/78 R |

*Primary Examiner*—H. Hampton Hunter
*Attorney, Agent, or Firm*—William J. Daniel

[57] ABSTRACT

A unitary burial undergarment including a torso section, leg sections and feet sections joined together into an integral assembly, the torso section at its shoulder and having at a central opening to accommodate the neck of the wearer, the back of the garment having a slit opening extending continuously from the neck opening to adjacent the waist and interconnecting with the proximate upper ends of two divergent slit openings extending to at least the upper ends of the leg sections. Closure means are provided for the several openings, such as zippers or the like.

5 Claims, 4 Drawing Figures

UNITARY BURIAL UNDERGARMENT

BACKGROUND OF THE INVENTION

At the present time, it is the current practice in the undertaking field in preparing the remains of deceased persons for funeral services and burial, to clothe only such portions of the remains as will be exposed to view during any viewing of the remains by the family and friends of the deceased. Since only the upper torso, arms and head of the body are normally visible for purpose of viewing, provision is made for clothing only these bodily portions. Thus, male cadavers are typically dressed in a specially constructed "fake" shirt which has a normal appearing front section but at the back is left open or constituted of overlapping or loosely fastened panels for easy application, together with a suit coat or jacket which at the back is either specially constucted in the same way or simply slit open through its full length. In similar fashion, blouses or dresses typically used to dress female cadavers are specially made with an open back construction or slit along their full length. The remainder of the body in either case is merely covered by a casket blanket or quilt formed as a part of the lining of the casket or provided separately by the mortician. While this blanket or quilt shields the lower bodily regions from direct view, it does not constitute an effective covering for such regions.

Rigor mortis reaches completion within a few hours after death and ordinarily long before the mortician can have convenient access to the body for purposes of burial preparation. Consequently, some special modification of clothing used for funeral purposes is unavoidable to permit such clothing to be applied over the rigid bodily members of the deceased. However, unusual circumstances can arise where it would be desirable for the remains to be fully clothed, for instance for sanitary reasons. Moreover, certain particularly sensitive persons, especially when caught up in the emotional strain incidental to the death of a relative or close friend, might well find repugnant the notion of allowing the remains to undergo burial in largely unclothed condition or might for esthetic reasons prefer in any case the body to be essentially fully clothed in an undergarment underlying the usual exterior burial garments.

The object of the invention is therefore to provide a unitary or one-piece burial undergarment which is designed and constructed to envelop essentially the entire body, exclusive of the head, of the deceased but is nonetheless capable of being donned without undue difficulty onto a fully rigid corpse.

This and other objects and advantages will be made apparent by the following detailed description when read in conjunction with the accompanying drawings.

BRIEF DESCRIPTION OF THE DRAWINGS

FIGS. 1 and 2 are rear and front views, respectively, of a burial undergarmet according to the invention intended for a male corpse while

DETAILED DESCRIPTION OF PREFERRED EMBODIMENTS

Figure 1:
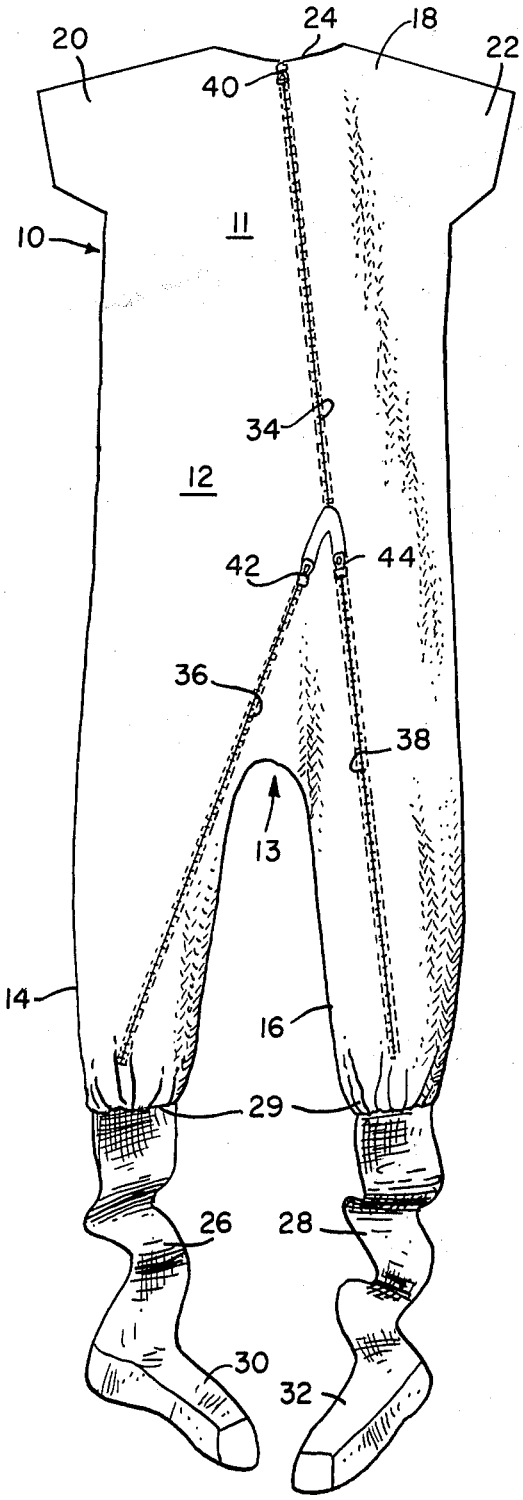
Figure 2:
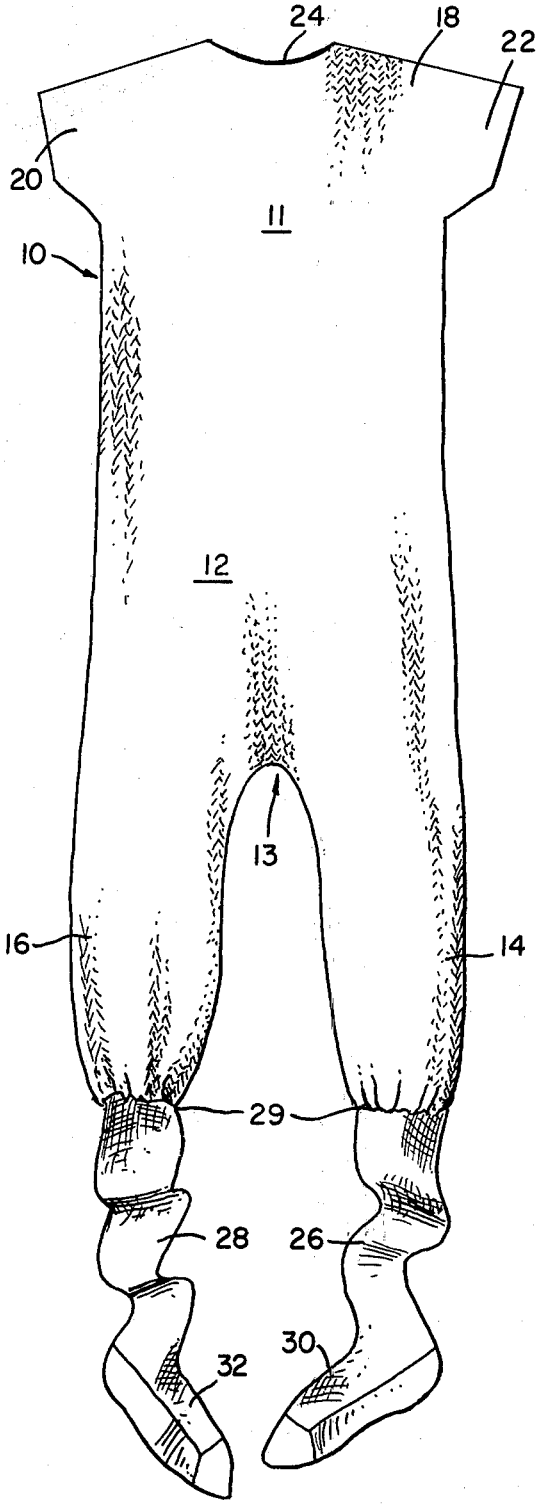

Referring first to FIGS. 1 and 2, showing a male type undergarment, the numeral 10 generally designates the torso portion of the undergarment which includes upper and lower torso sections 11 and 12 formed together and serving to cover together the entire torso region of the body. The lower end of lower torso section 12 is bifurcated to define a crotch at 13, and extended from the crotch into separate leg sections 14 and 16. The shoulder section 18 at the upper end of upper torso section 11 is preferably moderately enlarged and may be extended at the corners into full length sleeves or, as shown in this embodiment, more rudimentary sleeve sections 20,22. A central opening 24 is left in shoulder section 18 to accommodate the neck of the deceased.

Leg sections 14 and 16 are of lengths such as to preferably terminate shortly below the knee of the wearer and are integrally joined to hose sections 26,28 which conclude with shaped foot pockets 30,32. Where the hose sections 26,28 are of generally form-fitting configurations as shown, they should be made of knitted or other extensible fabric so as to be readily stretched during application. Hosiery sections 26,28 can be fabricated separately and attached to the leg sections by stretched seams as at 29. On the other hand, these sections 26,28 could be of ordinary woven fabric if of sufficiently loose or baggy conformation to allow easy donning. Because of the special closure arrangement provided at the back, next to be described, the torso and leg sections can be constructed of ordinary woven fabric although knit fabric is not excluded if preferred.

As appears in FIG. 1, the upper torso section 11 of the undergarment has an upper slit opening running down roughly the center of the back as at 34 from neck opening 24 to a point somewhat below the waist generally corresponding to the location of the buttocks, and from that point two interconnecting lower slit openings 36,38 extend, similar to the arms of an inverted "Y," down through leg sections 14,16 to adjacent the ends thereof at seams 29. Each of slits 34,36,38 are equipped with closure means, shown in the form of zippers 40,42,44, respectively, although buttons, snaps, hooks, "Velcro" fabric fasteners and the like could be substituted with generally satisfactory results. With form-fitting hosier sections, the leg zippers can terminate slightly short of seams 29, leaving the remainder of slits 36,38 open since the gathering effect of the top of the hosiery sections serves to hold the remainder of the leg slits effectively closed. With loose hosiery sections, the leg slits should extend down the leg section and into the hosiery section if necessary a sufficient distance to permit placement into such sections of the feet of the corpse.

Where the torso section 10 is made of a single piece of fabric, the back slit 34 and one of the hip and leg slit openings 36,38 can be arranged on a common rectilinear line for convenience in fabrication, the back opening 34 being slightly inclined from the vertical for this purpose as seen in FIG. 1. This arrangement also allows a single zipper to serve the entirety of these two openings, although separate zippers give greater flexibility and are preferred as shown.

Figure 3:
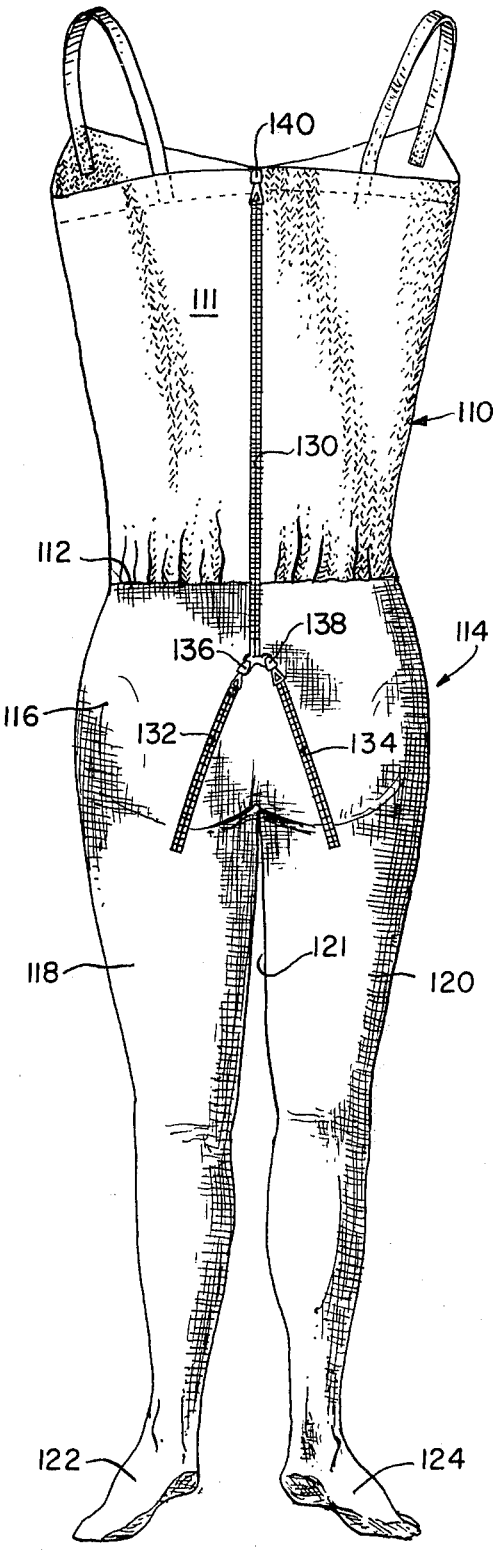
FIGS. 3 and 4 are similar views of another garment modified for a female corpse.
Figure 4:
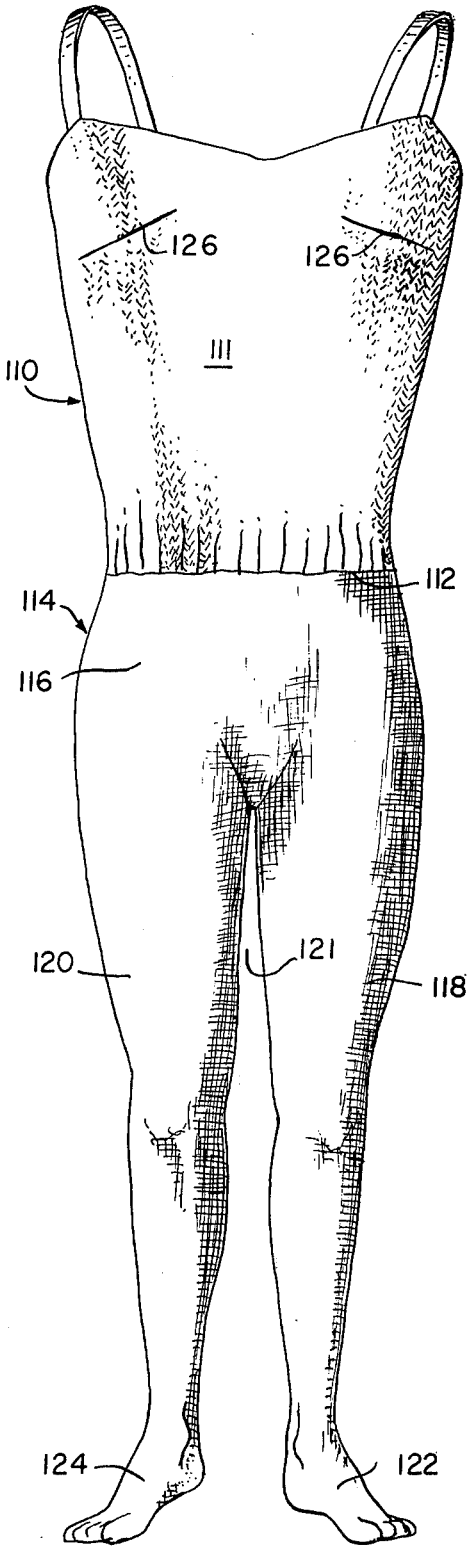

While the version of the present burial garment shown in FIGS. 1 and 2 can be quite acceptably worn by females, a modified construction specially designed to meet the peculiar anatomical and esthetic requirements of females is depicted in the embodiment of FIGS. 3 and 4. Here the torso section 110 includes a separate upper torso section 111 stopping approximately at waist level where it is joined by a stitched seem 112 to a composite form-fitting lower unit 114 containing in a single fabricated article sections corresponding to the lower torso, leg and hosiery sections of the embodiment of FIGS. 1 and 2. Due to the form-fitting nature of lower section 114, it must be made of extensible fabric, such as knitted fabric, and a conventional panty hose construction is ideally suited for this purpose as indicated in the drawing. Such panty hose includes the hip or panty section 116, constituting in this case a lower torso section, leg sections 118,120 separated by a crotch 121, and shaped foot pockets 122,124. These sections may all be formed into a continuous garment or, alternatively, as symmetrical semi-sections joined by a generally U-shaped seam extending from the centers of the front and back waist under the crotch, as is known in the art. The opacity or fabric density of the various sections of lower unit 114 can differ from one another if desired, again as is known.

The upper torso section 111 is preferably similar in construction to an abbreviated chemise-like garment, including shaping for the bust, indicated by bust darts 126, and being open at the shoulders except for lingerie-type straps 128. Sections 111 is preferably formed of a lingerie-type fabric, such as trico knit and the like.

As in the initial embodiment, the modified version of FIGS. 3 and 4 is provided in its back with means to facilitate its placement on the body. Thus, upper torso section 111 has an upper slit opening 130 extending down the center of the back into the upper end of lower torso section 116 where it joins the upper ends of two lower slit openings 132,134 extending over the respective buttock regions and terminating in the upper end of leg regions 118,120. These slit openings are each adapted to be closed by closure means, as at 136,138,140, respectively, although other types of closures, e.g., buttons, snaps, hooks, "Velcro" fabric, etc. could be employed. In the event the lower section 114 is not made of extensible fabric, the slit openings 132,134 and their associated closure means would need to be extended further along the leg regions, as indicated in the original embodiment.

In the course of the above description, reference has been made to particular types of fabric that might be selected for particular components of the present undergarments, but it will be appreciated that the type and quality of the fabric could be widely varied dependent upon applicable esthetic and economic considerations. Moreover, alterations and modifications in the construction of the undergarments of this invention in addition to those already suggested may well occur to the skilled worker without departing from the spirit of the invention.

What is claimed is:

1. A unitary burial undergarment comprising upper and lower torso sections, leg sections, and feet sections joined together in an integral garment assembly adapted to cover the full body of the deceased at least below the shoulders, at least said feet sections being knitted, said torso section having a neck opening therein, the back side of said torso section having an upper slit opening therein extending from said neck opening to the waist level of said torso section, the back side of said lower torso section having two lower slit openings diverging from a common termination communicating with the lower end of said upper slit opening in generally inverted Y-shaped fashion across the respective buttocks into at least the upper ends of said leg sections to points at least adjacent to knitted sections; and closure means to close the respective slit openings.

2. The burial undergarment as in claim 1 wherein said torso sections are formed together and include extensions constituting said leg sections, said leg sections stopping at approximately knee level and being joined to knitted hosiery sections provided with shaped feet pockets.

3. The undergarments of claim 1 wherein said lower torso, leg and feet sections are formed as a unitary continuous knitted article which is joined at the waist end thereof to a chemise-like upper torso section.

4. The burial undergarment of claim 1 wherein said upper slit opening and one of said lower slit openings lie on a common rectilinear line extending continuously at a slightly oblique angle from said neck opening into the corresponding leg section.

5. The burial undergarment of claim 1 wherein said closure means are zippers.

* * * * *